US007128462B2

(12) United States Patent
Swisher

(10) Patent No.: US 7,128,462 B2
(45) Date of Patent: Oct. 31, 2006

(54) CYLINDRICAL MIXING DRUM ASSEMBLY INCLUDING END WIPERS AND ENLARGED CHUTE

(76) Inventor: James A. Swisher, 2497 Castellon Dr. N., Jacksonville, FL (US) 32217

( * ) Notice: Subject to any disclaimer, the term of this patent is extended or adjusted under 35 U.S.C. 154(b) by 125 days.

(21) Appl. No.: 10/795,469

(22) Filed: Mar. 8, 2004

(65) Prior Publication Data

US 2005/0195682 A1 Sep. 8, 2005

(51) Int. Cl.
*B28C 5/14* (2006.01)

(52) U.S. Cl. ..... 366/47; 366/67; 366/312

(58) Field of Classification Search ..... 366/45–47, 366/64–67, 185, 309–313, 606
See application file for complete search history.

(56) References Cited

U.S. PATENT DOCUMENTS

| | | | | | |
|---|---|---|---|---|---|
| 1,540,547 | A * | 6/1925 | Doidge | ..... | 366/46 |
| 1,630,789 | A * | 5/1927 | Newman | ..... | 366/46 |
| 1,708,947 | A * | 4/1929 | Jaeger | ..... | 366/67 |
| 2,499,052 | A * | 2/1950 | Brookins | ..... | 366/47 |
| 2,580,551 | A * | 1/1952 | Kacena | ..... | 366/67 |
| 3,251,579 | A * | 5/1966 | Lasar | ..... | 366/185 |
| 4,043,540 | A * | 8/1977 | Stone | ..... | 366/222 |
| 4,478,515 | A * | 10/1984 | Tobin | ..... | 366/67 |
| 4,660,987 | A * | 4/1987 | Robinson | ..... | 366/67 |
| 5,067,818 | A * | 11/1991 | Howe | ..... | 366/46 |
| 5,441,341 | A * | 8/1995 | Halsted | ..... | 366/47 |
| 2005/0195682 | A1* | 9/2005 | Swisher | ..... | 366/47 |
| 2006/0034146 | A1* | 2/2006 | Lang | ..... | 366/46 |

FOREIGN PATENT DOCUMENTS

| | | | |
|---|---|---|---|
| GB | 2173415 A | * | 10/1986 |
| JP | 9-248819 | * | 9/1997 |

* cited by examiner

*Primary Examiner*—Charles E. Cooley
(74) *Attorney, Agent, or Firm*—Arthur G. Yeager

(57) ABSTRACT

A cylindrical mixing drum for mortar and similar material includes a drum body having a hollow shell with upper and lower portions and front and rear portions and an opening having front and rear portions in the upper portion and a pair of spaced substantially parallel and opposite end plates with a paddle shaft rotatably mounted between the plates. A first pair of spaced paddles is used for forcing a mix in a first direction and a second pair of paddles is used for forcing a mix in a second direction. A pair of spaced drum end scrapers are also mounted on the shaft closely adjacent the interior surface of an end wall. A pair of drum end wipers is also included for wiping another portion of the end wall. The lower portion of the drum shell is substantially cylindrical in shape from the front portion of the opening to the rear portion of the opening and the paddles are positioned on the shaft to be closely adjacent the interior surface of the drum shell as the shaft is rotated through 360°.

17 Claims, 4 Drawing Sheets

CYLINDRICAL MIXING DRUM ASSEMBLY INCLUDING END WIPERS AND ENLARGED CHUTE

CROSS-REFERENCE TO RELATED APPLICATION

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to drum assemblies used in portable mortar mixing apparatus.

2. Related Art

Conventional drum design includes a straight back portion which results in a "dead zone" where the mortar is not easily mixed. The existence of such a dead zone significantly extends the time needed to complete the mixing process. What is needed is a new drum configuration and additional changes in the mixing paddles and the drum chute to provide improved mixing and speedier delivery of the mixed mortar.

BRIEF SUMMARY OF THE INVENTION

In one aspect of the present invention there is provided a mixing drum for mortar and similar material comprising a drum body including a hollow shell having upper and lower portions and front and rear portions and an opening having front and rear portions in the upper portion of the shell and a pair of spaced substantially parallel and opposite end plates, the drum shell and the end plates having interior surfaces. A paddle shaft is rotatably mounted between the end plates, a pair of spaced first paddles is attached by first mounts to the shaft for forcing a mix in the drum in a first direction and a pair of second spaced paddles attached by second mounts to the shaft for forcing a mix in the drum in a second direction. A pair of spaced drum end scrapers are mounted on the shaft closely adjacent the interior surface of respective end wall of the drum for scraping a portion of the end wall interior surface. A pair of drum end wipers are mounted on a respective one first paddle closely adjacent the interior surface of the respective end wall of the drum for wiping another portion of the end wall interior surface and being spaced from the portion.

The front portion of the opening is defined by a pair of upstanding wall portions continuous with respective end wall and a front wall portion continuous with and extending between the upstanding wall portions, the wall portions defining a channel for directing the discharge of material from the drum. The front wall portion includes a section tapered downwardly in height from one upstanding wall portion to a location adjacent one upstanding wall portion. The lower portion of the drum shell is substantially cylindrical in shape from the front portion of the opening to the rear portion of the opening, the paddles being positioned on the shaft to be closely adjacent the interior surface of the drum shell as the shaft is rotated through 360°. The first and second mounts include clamp members for removably mounting the paddles to the shaft. Each drum end wiper is removably mounted to respective first paddle. Each wiper includes a rubber member located and positioned to be in sliding contact with the interior surface of respective end wall.

In another aspect of the present invention there is provided a mixing drum for mortar and similar material comprising a drum body including a hollow shell having upper and lower portions and front and rear portions and an opening having front and rear portions in the upper portion of the shell and a pair of spaced substantially parallel and opposite end plates, each having interior surfaces. A paddle shaft is rotatably mounted between the end plates. A pair of spaced first paddles is attached by first mounts to the shaft for forcing a mix in the drum in a first direction and a pair of second spaced paddles attached by second mounts to the shaft for forcing a mix in the drum in a second direction. A pair of spaced drum end scrapers is mounted on the shaft, each being mounted closely adjacent the interior surface of the respective end wall of the drum for scraping a portion of the end wall interior surface. The front portion of the opening is defined by a pair of upstanding wall portions continuous with the respective end wall and a front wall portion continuous with and extending between the upstanding wall portions, the wall portions defining a channel for directing the discharge of material from the drum, the channel located adjacent one end plate.

There is also a pair of drum end wipers, each mounted on a respective one first paddle. A portion of the wiper is in contact with the interior surface of the respective end wall of the drum for wiping another portion of the end wall interior surface and being spaced from the portion. The front portion of the opening is defined by a pair of upstanding wall portions continuous with the respective end wall and a front wall portion continuous with and extending between the upstanding wall portions, the wall portions defining a channel for directing the discharge of material from the drum. The front wall portion includes a section tapered downwardly in height from one upstanding wall portion to a location adjacent one upstanding wall portion. The first and second means include clamp members for removably mounting the paddles to the shaft. Each drum end wiper is removably mounted to the respective first paddle.

In a further aspect of the present invention there is provided a mixing drum for mortar and similar material comprising a drum body including a hollow shell having upper and lower portions and front and rear portions and an opening having front and rear portions in the upper portion of the shell and a pair of spaced opposite end plates, the drum shell and end plates having interior surfaces. A paddle shaft is rotatably mounted between the end plates and a pair of spaced first paddles is attached to the shaft for forcing a mix in the drum in a first direction and a pair of second spaced paddles attached to the shaft for forcing a mix in the drum in a second direction. A pair of spaced drum end scrapers is mounted on the shaft closely adjacent the interior surface of the respective end wall of the drum for scraping a portion of the end wall interior surface. The lower portion of the drum shell is substantially cylindrical in shape from the front portion of the opening to the rear portion of the opening. Each of the paddles and the scraper is positioned on the shaft to be in contact with the interior surface of the drum as the shaft is rotated through 360°. There is also a pair of drum end wipers, each drum end wiper being removably mounted on a respective one first paddle in contact with the interior surface of the respective end wall of the drum for wiping another portion of the end wall interior surface and being spaced from the portion.

The front portion of the opening is defined by a pair of upstanding wall portions continuous with the respective end wall and a front wall portion continuous with and extending between the upstanding wall portions, the wall portions defining a channel for directing the discharge of material from the drum. The front wall portion includes a section tapered downwardly in height from one upstanding wall portion to a location adjacent one upstanding wall portion. There is also a pair of drum end wipers, each drum end wiper being removably mounted on a respective one first paddle in contact with the interior surface of the respective end wall of the drum for wiping another portion of the end wall surface and being spaced from the portion as the shaft is rotated through 360°, the front portion of the opening being defined by a pair of upstanding wall portions continuous with the respective end wall and a front wall portion continuous with and extending between the upstanding wall portions, the wall portions defining a channel for directing the discharge of material from the drum.

In an additional aspect of the present invention there is provided a mixing drum for mortar and similar material comprising a drum body including a hollow shell having upper and lower portions and front and rear portions and a forward end and a rearward end adjacent an engine and an opening having front and rear portions in the upper portion of the shell and a pair of spaced opposite end plates, the drum shell and the end plates having interior surfaces, a paddle shaft rotatably mounted between the end plates, a pair of spaced first paddles, first mounts for attaching the first paddles to the shaft for forcing a mix in the drum in a first direction and a pair of second spaced paddles, second mounts for attaching the second paddles to the shaft for forcing a mix in the drum in a second direction.

The opening includes a discharge channel formed adjacent the forward end of the body to allow for the positioning of an axle and wheel mounted thereon below and between such engine and the drum body to minimize interference between such wheel and the discharge of material from the drum body through the discharge channel.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Introduction

The most efficient way to mix mortar or stucco would require a large closed tube employing a spiral blade that would move the mix from side to side. Practically speaking however, such a device would not have a means to load the ingredients into such a tube.

To increase the speed of mixing and improve the operator's control of the discharge of mortar, the present invention provides for improvements in three areas: (1) the shape of the drum; (2) the paddle and mixing blades are reconfigured and additional apparatus is added; and (3) the drum discharge chute is redesigned.

1. The mixing drum has been redesigned to be substantially cylindrical with a diameter roughly the same as the diameter of mixing paddles that are mounted on a rotating shaft that is mounted through the drum. The "flat back" portion found on conventional drums has been eliminated.
2. In addition to the four mixing paddles that are generally used, two horizontally opposed drum end scrapers are added thereby increasing the total paddle surface. Drum end wipers are also added.
3. The present mixing drum employs a front-positioned drum chute that is narrower than usual. The use of a narrower chute allows for greater control of the mix discharge but without a reduction in the rate of discharge because the additional end scrapers put an increased push on the discharging mix.

Figure 1:
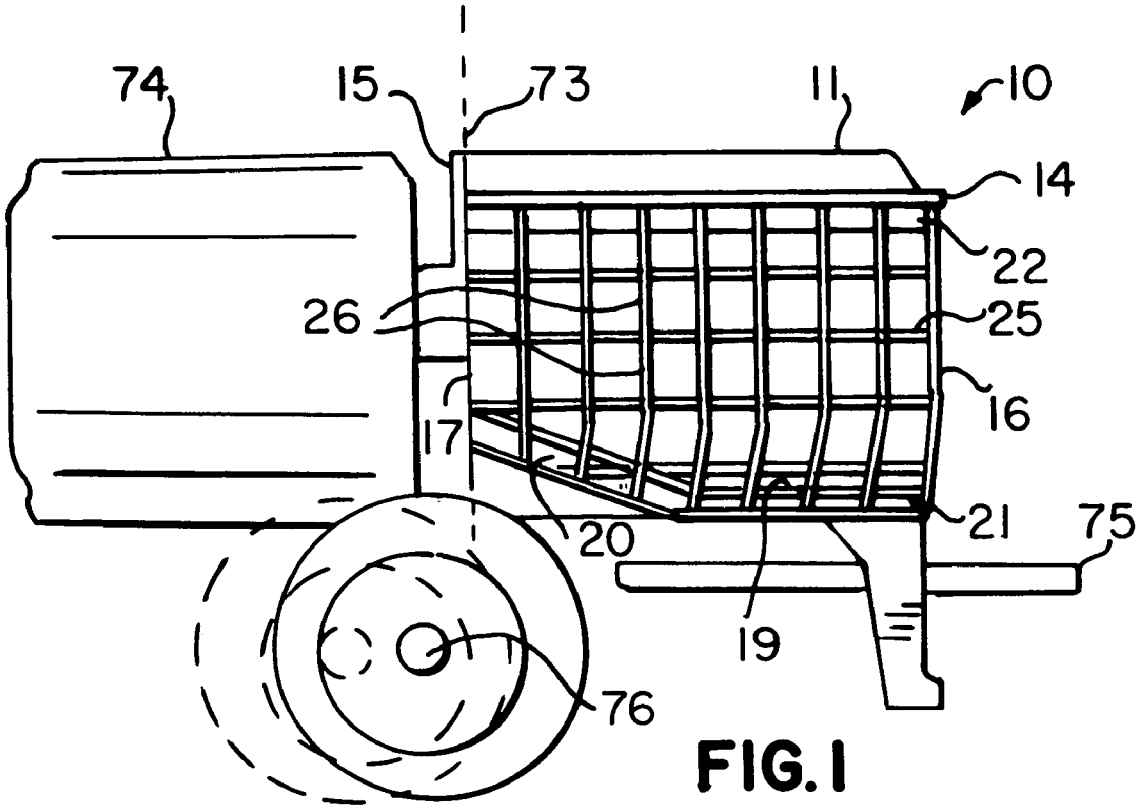
FIG. 1 is a side pictorial view of the mixing drum and attached engine in accord with the present invention.
Figure 2:
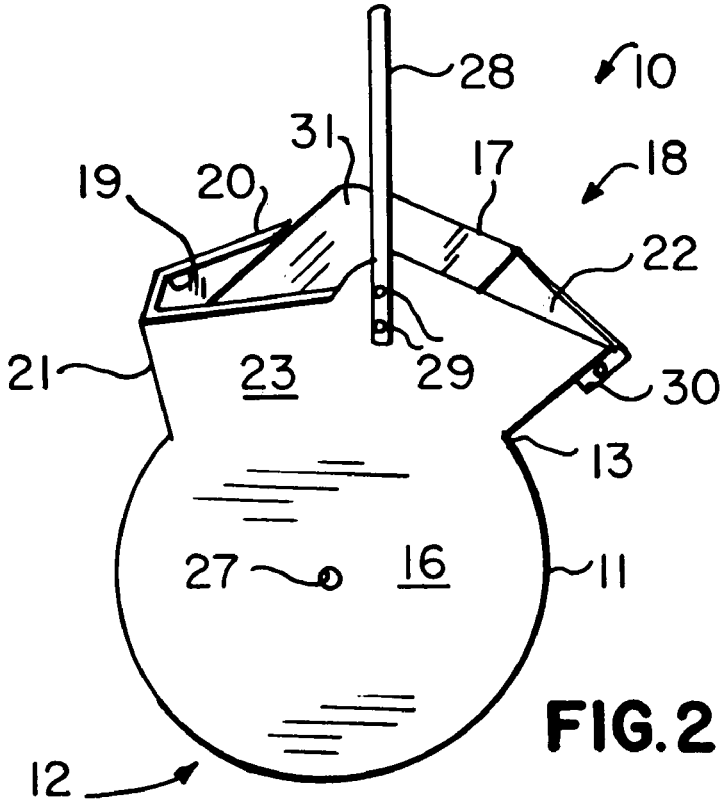
FIG. 2 is a partial end view of the drum of FIG. 1.
Figure 5:
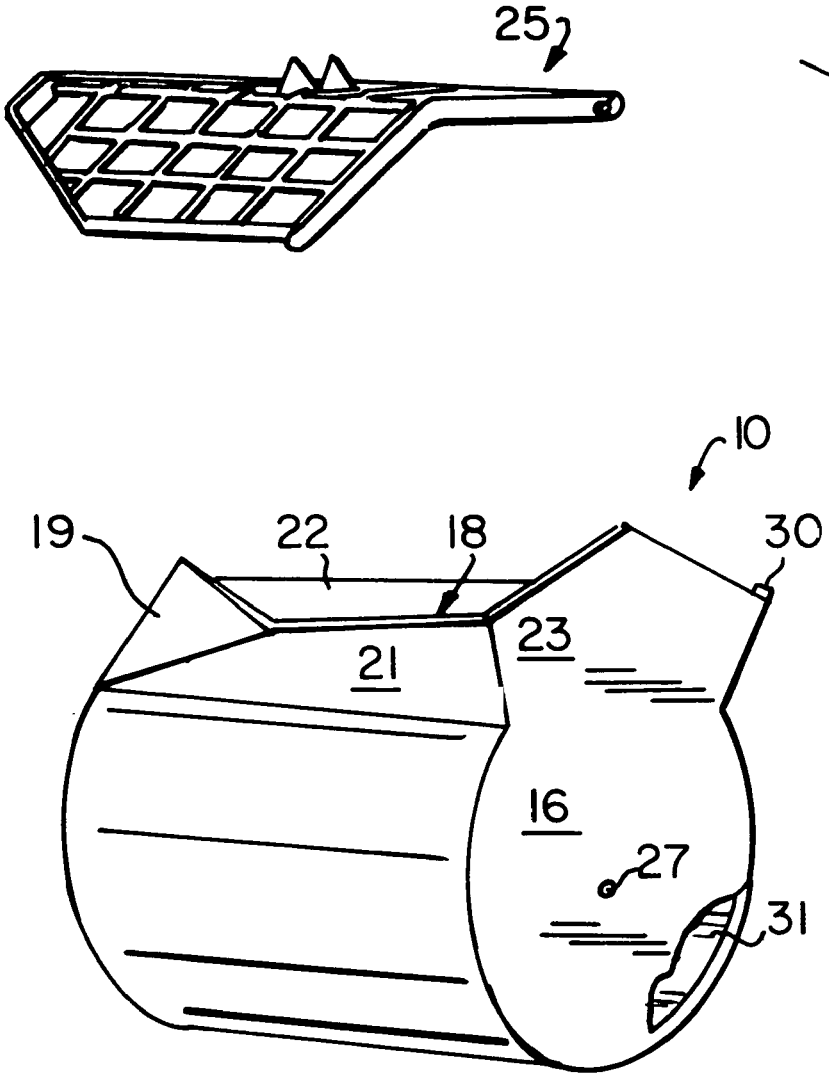
FIG. 5 is an alternative view of the mixing drum shown in FIG. 1.
Figure 6:
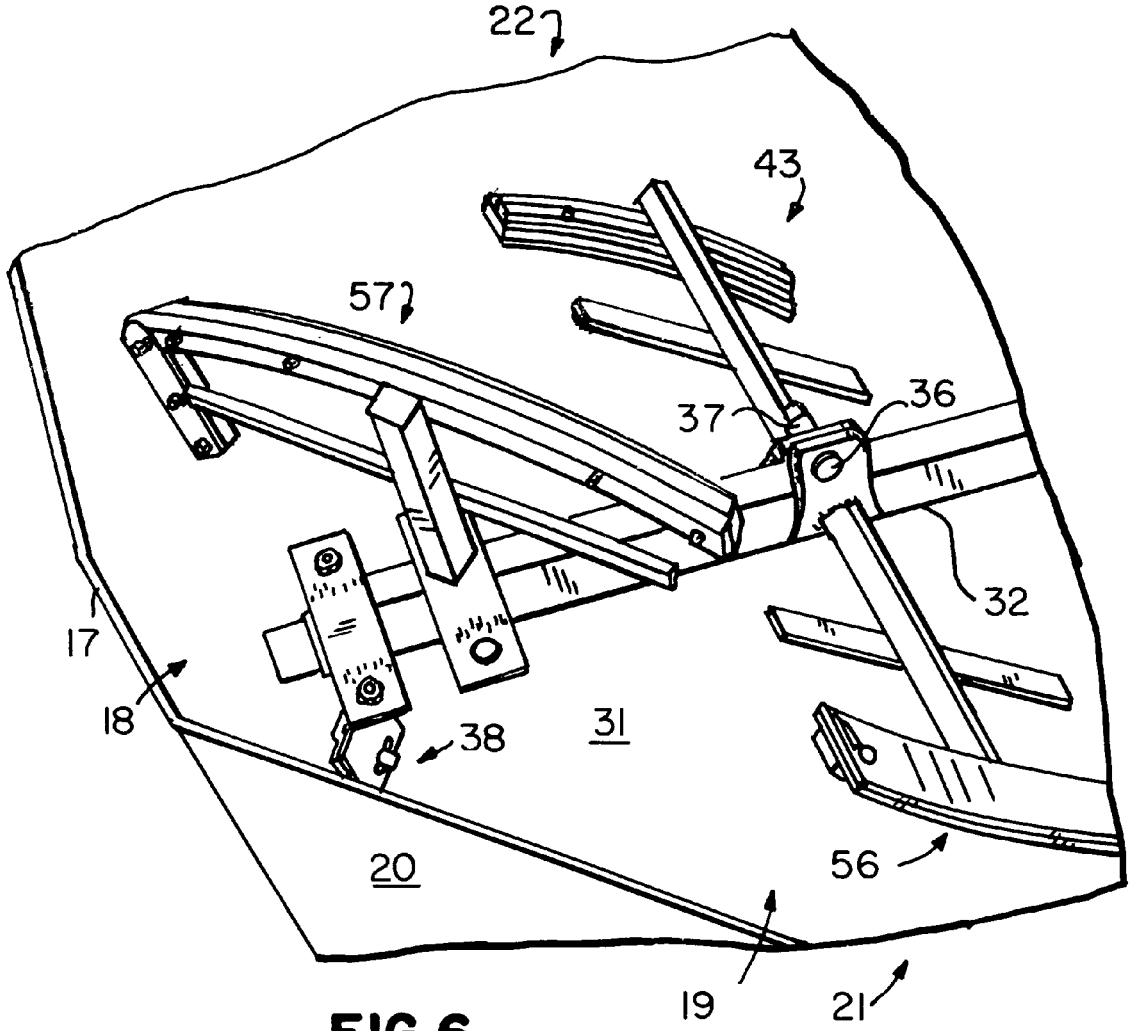
FIG. 6 is a partial pictorial view of one end of the assemblies of FIGS. 3 and 4 installed in the drum of FIGS. 1 and 5.

With respect now to the drawings, the mixing drum assembly in accord with the present invention is shown generally at 10 in FIGS. 1 and 5. The drum body 11 includes a lower portion 12, upper portion 13, first end portion 14 near the forward towing end, second end portion 15 near the rearward engine end, and end walls 16 and 17. A passageway 27 for the paddle shaft 32 is formed in the end wall 16.

An opening 18 into the upper portion 13 of drum body 11 is shaped to form a discharge chute 19 defined by wall members 20, 21, 22 and an upper portion 23 of end wall 16 enclosing interior surface 31. Protective grate 25 includes cutting surfaces 29 for opening bags of mortar or other materials to be mixed. Grate 25 is mounted to rear wall 22 via hinge means 30. Operating handle 28 is secured to drum wall 16 via bolts 29.

Figure 3:
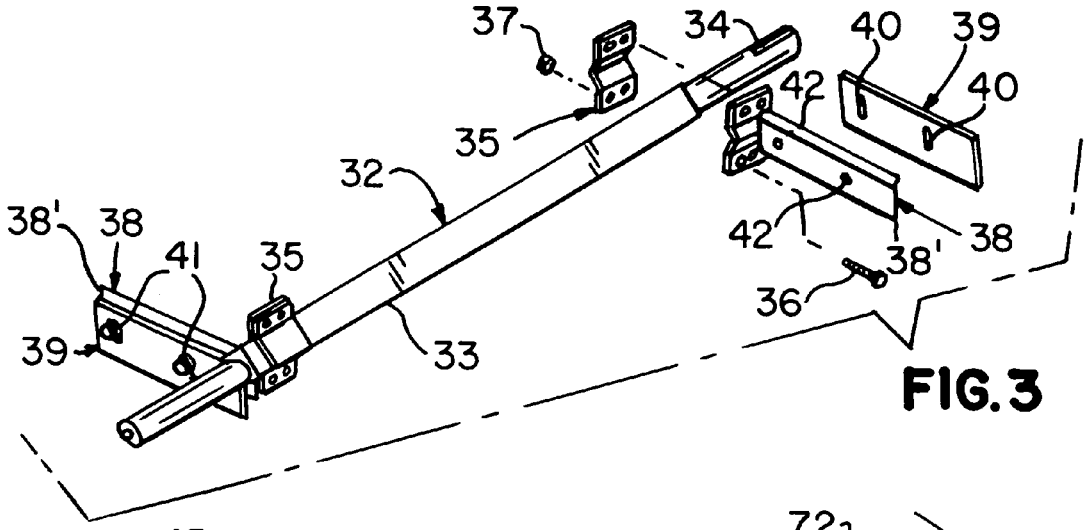
FIG. 3 is a partial pictorial exploded view of scraper assembly in accord with the present invention.

FIG. 3 illustrates paddle shaft 32 having a box-shaped section 33 and slot 34 for attachment to an engine 74 to which are mounted oppositely disposed drum end scraper assemblies 38 blades 39 attached to blade support arms 38' via volts 41 and bolt holes. Slots 40 are elongate to allow for adjustment of blade 39 to place it closely adjacent the interior surface 31 of drum body 11 at end walls 16 and 17. Arms 38' are attached to shaft 32 via respective clamps 35 and associated bolts 36 and nuts 37.

Figure 4:
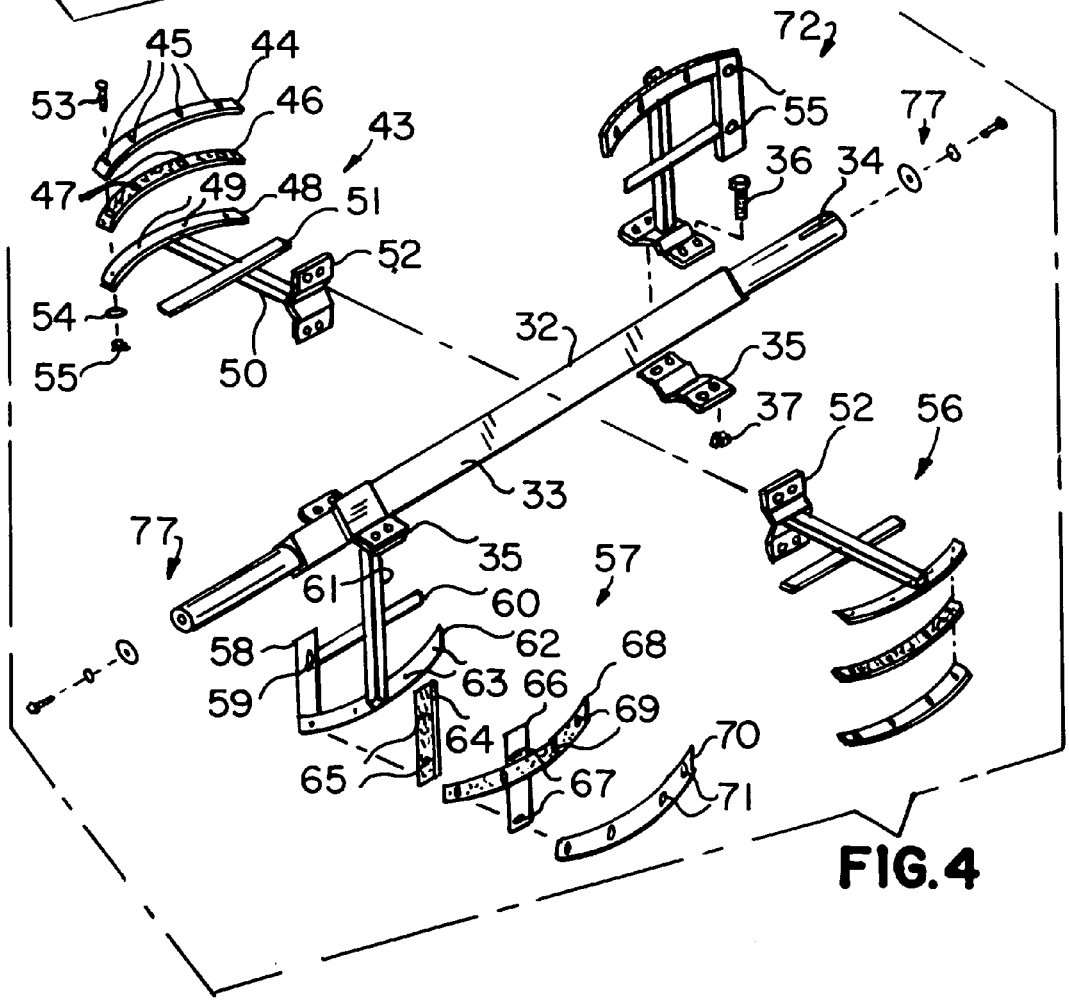
FIG. 4 is a partial pictorial exploded illustration of the paddle and wiper assembly in accord with the present invention.

FIG. 4 illustrates the mounting of paddles and wipers to the paddle shaft 32. The mounting of blades 39 is shown separately in FIG. 3 for ease of illustration.

A first center paddle 43 includes backplate 44 having bolt holes 45, rubber wiper 46 having bolt holes 47, and a frame arm 48 having bolt holes 49 welded to a frame member 50 including a cross arm 51 and mounting clamp 52. Bolts 53, washer 54, and nuts 55 are used to secure the assembly 43 together. A second oppositely disposed center paddle 56 is substantially identical in all respects to paddle 53. Clamps 52 are secured together with suitable bolts 36 and nuts 37.

Two other paddle assemblies are mounted on shaft 32. A backward paddle assembly 57 mounted adjacent the towing end of assembly 10 moves the mix towards the rearward engine end of the drum 11. The assembly 57 includes a vertically disposed drum end wiper arm 58 having a slot 59, a frame 61 with cross arm 60 and frame arm 62. Rubber wiper 64 has holes 65 for connection to arm 58 and backplate 66 also having bolt holes 67. A rubber drum wrap wiper 68 and backplate 70 having respective bolt holes 69, 71 are mounted to frame arm 62. Spaced and oppositely disposed forward paddle assembly 72 moves the mix towards the tow or forward end and is substantially identical in all respects to assembly 57.

The preferred assembly of the components is clearly shown in FIGS. 3 and 4. Backward paddle 57 is slanted to force the mortar mix towards the engine end and forward paddle 72 is slanted to force the mix towards the towing end.

In practice the edge of rubber members 46, 64, 68 are preferably adjustable to be in direct contact with the interior surface 31 of drum body 11 and the respective back plates should allow for a clearance of ⅛–¼" between the plates and interior surface 31. The blades 46, 64, 68 should not fold when the paddle 32 is rotated. Connecting means 77 are part of the apparatus used to mount shaft 32.

With respect again to FIGS. 1 and 5, the drum body 11 is cylindrical and accordingly, there is no "dead zone" wherein a portion of the mortar mix, often along the top back of a drum, is not under pressure of the various blades.

The width of discharge chute 19 has been narrowed from a width of approximately 21" in the prior art to approximately 14" to provide for more control of the mix during discharge. In addition, the position of the chute 19 has been moved approximately 5" towards the towing end. The addition of drum end scrapers 36 and wipers 56 provide additional force so that discharge of the mix is at least as quick with the narrower chute 19 as it was with the wider chute of the prior art.

With more environmental protection issues being watched on construction jobs, masons are not allowed to dump wastewater generated from cleaning, as with prior practice. "Dry cleaning" is becoming more and more necessary and prevalent. A mason "dry cleans" his mixer by beating on the outside of the drum with a heavy hammer to remove the mortar residue which was left by the previous days use of the mixer.

By using a heavier gauge of steel to fabricate the drum 11, and by adding the symmetrical curves to the drum's front and back, the drum 11 is superior in both mixing performance and has the strength to resist drum damage from the daily "dry cleaning" from the mason's hammer blows.

The "flush front" design of the new drum's discharge chute 19 including matching streamlined and free swinging protective grate 25 provides for better control of the mortar when being discharged from the mixer and also allows the wheel axle 76 to be brought further forward from engine 74 in front of the "drum line" for better balance of the heavier weight as indicated in FIG. 1. The actual weight of the tongue 75 can be reduced so that it weighs the same as a mixer whose overall weight is half of that of the present mixer.

The drum line 73 shows the new mixer with the older position of axle 76 shown in broken line. The tongue weight here is 160 pounds. The drum line 73 shows in solid line that axle 76 has been moved forward to position it below and between the engine 74 and drum body 11 by 5 inches. By doing this, the tongue weight is reduced by 60 pounds. This tongue weight reduction is significant. Even though the new mixer is twice as heavy as others similar in capacity, it requires the same strength to move around because of the axle positioning beyond the drum line. The feature is not possible in other mixers because the mixer's wheel would interfere with the dumping of the drum.

Drum end plates of a conventional drum body are very often identical or substantially similar. In the present invention the shape of the end plates 16 and 17 are formed to provide the symmetry necessary to eliminate the mix "dead zone" while providing for the forward position of the discharge chute 19 and additional overall strength of the drum body 11.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed is:

1. A mixing drum for mortar and similar material comprising a drum body including a hollow shell having upper and lower portions and front and rear portions and an opening having front and rear portions in said upper portion of said shell and a pair of spaced substantially parallel and opposite end plates, said drum shell and said end plates having interior surfaces, a paddle shaft rotatably mounted between said end plates, a pair of spaced first paddles, first mounts for attaching said first paddles to said shaft for forcing a mix in said drum in a first direction and a pair of second spaced paddles, second mounts for attaching said second paddles to said shaft for forcing a mix in said drum in a second direction, a pair of spaced drum end scrapers mounted on said shaft, each said scraper mounted closely adjacent said interior surface of respective said end wall of said drum for scraping a portion of said end wall interior surface, a pair of drum end wipers, each said drum end wiper mounted on a respective one said first paddle closely adjacent said interior surface of respective said end wall of said drum for wiping another portion of said end wall interior surface and being spaced from said portion.

2. The mixing drum as defined in claim 1 wherein said front portion of said opening is defined by a pair of upstanding wall portions continuous with respective said end wall and a front wall portion continuous with and extending between said upstanding wall portions, said wall portions defining a channel for directing the discharge of material from said drum.

3. The mixing drum as defined in claim 2 wherein said front wall portion includes a section tapered downwardly in height from one said upstanding wall portion to a location adjacent said one upstanding wall portion.

4. The mixing drum as defined in claim 1 wherein said lower portion of said drum shell is substantially cylindrical in shape from said front portion of said opening to said rear portion of said opening, said paddles being positioned on said shaft to be closely adjacent said interior surface of said drum shell as said shaft is rotated through 360°.

5. The mixing drum as defined in claim 1 wherein said first and second mounts include clamp members for removably mounting said paddles to said shaft.

6. The mixing drum as defined in claim 1 wherein each of said drum end wipers is removably mounted to respective said first paddles.

7. The mixing drum as defined in claim 1 wherein each said wiper includes a rubber member located and positioned to be in sliding contact with said interior surface of respective said end wall.

8. A mixing drum for mortar and similar material comprising a drum body including a hollow shell having upper and lower portions and front and rear portions and an opening having front and rear portions in said upper portion of said shell and a pair of spaced substantially parallel and opposite end plates, said drum shell and said end plates having interior surfaces, a paddle shaft rotatably mounted between said end plates, a pair of spaced first paddles, first mounts for attaching said first paddles to said shaft for forcing a mix in said drum in a first direction and a pair of second spaced paddles, second mounts for attaching said second paddles to said shaft for forcing a mix in said drum in a second direction, a pair of spaced. drum end scrapers mounted on said shaft, each said scraper mounted closely adjacent said interior surface of respective said end wall of said drum for scraping a portion of said end wall interior surface, a drum end wiper mounted on one of said first paddles, said front portion of said opening being defined by a pair of upstanding wall portions continuous with respective said end wall and a front wall portion continuous with and extending between said upstanding wall portions, said wall portions defining a channel for directing the discharge of material from said drum, said channel located adjacent one said end plate.

9. The mixing drum as defined in claim 8 further including another drum end wiper mounted on another of said first paddles, a portion of each said wiper being in contact with said interior surface of respective said end wall of said drum for wiping another portion of said end wall interior surface and being spaced from said portion.

10. The mixing drum as defined in claim 9 wherein each said drum end wiper is removably mounted to respective said first paddles.

11. The mixing drum as defined in claim 8 wherein said front wall portion includes a section tapered downwardly in height from one said upstanding wall portion to a location adjacent said one upstanding wall portion.

12. The mixing drum as defined in claim 8 wherein said first and second mounts include damp members for removably mounting said paddles to said shaft.

13. A mixing drum for mortar and similar material comprising a substantially cylindrical drum body including a hollow shell having upper and lower portions and front and rear portions and an opening having front and rear portions in said upper portion of said shell and a pair of spaced opposite end plates, said drum shell and said end plates having interior surfaces, a paddle shaft rotatably mounted between said end plates, a pair of spaced first paddles, first mounts for attaching said first paddles to said shaft for forcing a mix in said drum in a first direction and a pair of second spaced paddles, second mounts for attaching said second paddles to said shaft for forcing a mix in said drum in a second direction, a pair of spaced drum end scrapers mounted on said shaft, each said scraper mounted closely adjacent said interior surface of respective said end wall of said drum for scraping a portion of said end wall interior surface to provide an increased push on the discharging mix, said lower portion of said drum shell being substantially cylindrical in shape from said front portion of said opening to said rear portion of said opening each of said paddles and said scraper being positioned on said shaft to be in contact with said interior surface of said drum as said shaft is rotated through 360°, and a pair of drum end wipers, each said drum end wiper being removably mounted on a respective one said first paddle in contact with said interior surface of respective said end wall of said drum for wiping another portion of said end wall interior surface and being spaced from said portion.

14. The mixing drum as defined in claim 13 wherein said front portion of said opening is defined by a pair of upstanding wall portions continuous with respective said end walls and a front wall portion continuous with and extending between said upstanding wall portions, said wall portions defining a channel for directing the discharge of material from said drum.

15. The mixing drum as defined in claim 14 wherein said front wall portion includes a section tapered downwardly in height from one said upstanding wall portion to a location adjacent said one upstanding wall portion.

16. The mixing drum as defined in claim 13 further including a pair of drum end wipers, each said drum end wiper being removably mounted on a respective one said first paddle in contact with said interior surface of respective said end wall of said drum for wiping another portion of said end wall surface and being spaced from said portion as said shaft is rotated through 360°, said front portion of said opening being defined by a pair of upstanding wall portions continuous with respective said end wall and a front wall portion continuous with and extending between said upstanding wall portions, said wall portions defining a channel for directing the discharge of material from said drum.

17. A mixing drum for mortar and similar material comprising a drum body including a hollow shell having upper and lower portions and front and rear portions and a forward end and a rearward end adjacent an engine and an opening having front and rear portions in said upper portion of said shell and a pair of spaced opposite end plates, said front portion of said opening being defined by a pair of upstanding wall portions continuous with respective said end plates and a front wall portion continuous with and extending between said upstanding wall portions, said front wall portion including a section tapered downwardly in height from one said upstanding wall portion to a location adjacent said other upstanding wall portion, said wall portions defining a channel for directing the discharge of material from said drum, said drum shell and said end plates having interior surfaces, a paddle shaft rotatably mounted between said end plates, a pair of spaced first paddles, first mounts for attaching said first paddles to shaft for forcing a mix in said drum in a first direction and a pair of second spaced paddles, second mounts for attaching said second paddles to said shaft for forcing a mix in said drum in a second direction, said opening including said discharge channel formed adjacent said forward end of said body to allow for the positioning of an axle and wheel mounted thereon below and between such engine and said drum body to minimize interference between such wheel and the discharge of material from said drum body through said discharge channel.

* * * * *